US005921130A

United States Patent [19]

Yamada

[11] Patent Number: 5,921,130

[45] Date of Patent: Jul. 13, 1999

[54] HEAT EXCHANGING FIN AND DIE-PUNCH SET FOR MANUFACTURING THE SAME

[75] Inventor: Mamoru Yamada, Tokyo, Japan

[73] Assignee: Hidaka Seiki Kabushiki Kaisha, Tokyo, Japan

[21] Appl. No.: 08/978,148

[22] Filed: Nov. 25, 1997

[30] Foreign Application Priority Data

Nov. 28, 1996 [JP] Japan ..... 8-317443

[51] Int. Cl.[6] ..... B21D 53/04

[52] U.S. Cl. ..... 72/358; 72/335

[58] Field of Search ..... 72/327, 335, 355.4, 72/356, 358

[56] References Cited

U.S. PATENT DOCUMENTS 4,213,323 7/1980 De Deugd ..... 72/358
5,159,826 11/1992 Miyazawa et al. ..... 72/335

FOREIGN PATENT DOCUMENTS 63-74979 5/1988 Japan .
64-34522 2/1989 Japan ..... 72/335

*Primary Examiner*—Lowell A. Larson

[57] ABSTRACT

An object of the present invention is to provide a very thin heat exchanging fin, having collars with tough flanges that are not deformed when the heat exchanging tubes are integrated therewith. The heat exchanging fin includes: a plate section having a plurality of through-holes through which a heat exchanging tube will be pierced; and a plurality of collars having a prescribed height, each of the collars extending from an edge of each of the through-holes and having a flange at a front end, characterized in: that an inner face of each collar is formed perpendicular to the plate section; and that thickness of a base end part of each of the collars, which is connected to the plate section, is thicker than that of a middle part thereof. With this structure, the strength of the base end part of the collars can be greater even if the collars are made higher and thinner. The deformation of the collars can be prevented when the heat exchanging tubes are pierced and integrated with the collars.

4 Claims, 7 Drawing Sheets

HEAT EXCHANGING FIN AND DIE-PUNCH SET FOR MANUFACTURING THE SAME

BACKGROUND OF THE INVENTION

The present invention relates to a heat exchanging fin and a die-punch set for manufacturing the heat exchanging fin, more precisely relates to a heat exchanging fin having a plurality of collars, which enclose through-holes in a plate section and through which heat exchanging tubes will be pierced, and a die-punch set for manufacturing said heat exchanging fin.

The heat exchanging fin 10, which is employed in an air conditioner, etc., is shown in FIG. 9. The heat exchanging fin 10 includes: a belt-like thin plate section 11, which is made of a metallic thin plate, e.g., aluminium thin plate; a plurality of through-holes 12; and a plurality of collars 14, each of which extends upwardly from an edge of each through-hole 12. Namely, a plurality of collars 14 are linearly arranged in the longitudinal direction of the belt-like thin plate section 11. There is formed a flange 15 at an upper end of each collar 14.

The heat exchanging fins 10 are usually manufactured by a drawless manner (see FIGS. 10A–10D). In the drawless manner, firstly small through-holes 101 are formed in the thin plate by pierce machining (see FIG. 10A. Edges 102 of the small through-holes 101 are upwardly bent by burring so as to form them into projected sections 103 (see FIG. 10B). Then the projected sections 103 are upwardly squeezed by squeezing so as to form the collars 104 (see FIG. 10C). Finally, the flange 105 is formed at the upper end of each collar 104 by flare machining (see FIG. 10D).

The heat exchanging fins 10 are piled as shown in FIG. 11. Then, a heat exchanging tube 16, which is made of a metal having high heat conductivity, e.g., copper, is pierced through the through-holes 12 of the heat exchanging fins 10, which have been coaxially arranged. Since the flanges 15 respectively contact a bottom face of the heat exchanging fin 10 on the upper side, spaces are kept between the adjacent heat exchanging fins 10. Namely, the heat exchanging fins 10 are mutually separated with the distance equal to the height of the collars 14.

There are formed spaces 12*a* between an outer circumferential face of the heat exchanging tube 16 and inner circumferential faces of the collars 14, so the heat exchanging tube 16 is expanded by inserting an expanding bullet 17. By inserting the expanding bullet 17 into the heat exchanging tube 16, the heat exchanging tube 16 can be integrated with the collars 14 of the heat exchanging fins 10, so that the heat exchanging ability can be raised.

In some cases, the separation between the adjacent heat exchanging fins 10 is made wider by forming higher collars 14. Since the collars 14 are formed by squeezing the projected sections which extend from the edges of the through-holes 12, the thickness of the collars 14 is made thinner if the collars 14 are made higher.

In the case of providing thin collars 14, the flanges 15 are apt to be broken as shown in FIG. 12. Note that, a broken part is indicated by numeral 19.

If the thickness of base ends of the collars 14, which connect the collars 14 with the plate section 11, is very thin, the collars 14 are apt to be deformed when the heat exchanging tubes 16, which have been pierced through the collars 14, are integrated with the heat exchanging fins 10 by inserting the bullet 17. If the collars 14 are deformed, the adjacent fins 10 mutually contact and the distance therebetween is not fixed (see FIG. 13), so that the heat exchanging ability is reduced.

The broken flange 19 and the mutual contact between the adjacent heat exchanging fins 10 are apt to occur in the very thin heat exchanging fins 10. However, these days thinner heat exchanging fins 10 are required to provide lighter heat exchangers.

SUMMARY OF THE INVENTION

An object of the present invention is to provide a very thin heat exchanging fins having collars with tough flanges and that are not deformed when the heat exchanging tubes are integrated with.

Another object of the present invention is to provide a die-punch set for manufacturing said heat exchanging fins.

The heat exchanging fin of the present invention includes: a plate section having a plurality of through-holes through which a heat exchanging tube will be pierced; and a plurality of collars having a prescribed height, each of the collars extending from an edge of each of the through-holes and having a flange at a front end, characterized in:

that an inner face of each the collar is formed perpendicular to the plate section; and that a thickness of a base end part of each the collar, which is connected to the plate section, is thicker than that of a middle part thereof.

By employing the heat exchanging fin of the present invention, the strength of the base end part of the collars can be greater even if the collars are made higher and thinner. So the deformation of the collars can be prevented when the heat exchanging tubes are pierced and integrated with the collars.

In the heat exchanging fin, the outer diameter of the base end part of each of the collars may be greater than that of the middle part thereof. With this structure, the heat exchanging tubes can be smoothly pierced through the collars, and the heat exchanging tubes can be tightly integrated with the inner faces of the collars.

In the heat exchanging fin, the thickness of the middle part of each of the collars may be gradually made thicker toward the front end thereof, at which the flange is formed. With this structure, forming cracks in the flanges or breaking the flanges can be prevented when the flanges are formed at the front ends of the collars.

A first basic structure of the die-punch set of the present invention is a die-punch set for forming a plurality of collars in a plate section of a heat exchanging fin, through which a heat exchanging tube will be pierced, by squeezing projected sections of the plate section, each of which projects from an edge of each through-hole in the plate section, between an inner face of a die and an outer face of a punch until reaching a prescribed height, characterized in:

that the punch has a squeezing section in a front end section;

that the die includes:

a first end to which the front end of the punch enters;

a second end which is an opposite end with respect to the first end;

a first cylindrical section extending a prescribed length from the first end toward the second end, wherein an inner face of the first cylindrical section is arranged perpendicular to the plate section; and a second cylindrical section extending from the first cylindrical section toward the second end, wherein inner diameter of the second cylindrical section is made smaller than that of the first cylindrical section so as to squeeze the projected section with the squeezing section of the punch, and wherein an inner face of the second cylindrical section is arranged perpendicular to the plate section; and that a front end of the collar exists in the second cylindrical section of the die when the collar is completely squeezed.

By employing the die-punch set of the first basic structure, the inner faces of the collars are formed perpendicular to the plate section. And the thickness of the base end part of each of the collars, which is connected to the plate section, can be thicker than that of the middle part of each of the collars.

A second basic structure of the die-punch set of the present invention is a die-punch set for forming a plurality of collars in a plate section of a heat exchanging fin, through which a heat exchanging tube will be pierced, by squeezing the projecting sections of the plate section, each of which projects from an edge of each through-hole in the plate section, between an inner face of a die and an outer face of a punch until reaching a prescribed height, characterized in:

that the punch has a squeezing section in a front end section;

that the die includes:

a first end to which the front end of the punch enters;

a second end which is an opposite end with respect to the first end;

a cylindrical section extending a prescribed length from the first end toward the second end, wherein an inner face of the cylindrical section is arranged perpendicular to the plate section;

a small diameter section extending on the second end side of the cylindrical section, wherein inner diameter of the small diameter section is made smaller than that of the cylindrical section so as to squeeze the projected section with the squeezing section of the punch; and a female tapered section, which is extended from the second cylindrical section toward the second end, and whose inner diameter is gradually made greater toward the second end; and that a front end of the collar exists in the second cylindrical section of the die when the collar is completely squeezed.

By employing the die-punch set of the second basic structure, the inner faces of the collars are formed perpendicular to the plate section. The thickness of the base end part of each of the collars, which is connected to the plate section, can be thicker than that of the middle part of each of the collars. And the thickness of the middle part of each of the collars can be made gradually thicker toward the front end at which the flange is formed.

In the first and the second basic structures, the punch may have a reverse tapered section, which extends from the squeezing section toward a base end of the punch, and whose outer diameter is gradually made smaller toward the base end. With this structure, machining oil can enter a space between the reverse tapered section of the punch and the inner face of the collar, so that mutual fusing between the punch and the collar, which is caused by frictional heat of squeezing, can be prevented.

In the first and the second basic structures, the punch may have a tapered section, extending from the squeezing section toward a front end of the punch, and whose outer diameter is gradually made smaller toward the front end. With this structure, the punch can smoothly enter the projected sections.

Further, in the first and the second basic structures, the punch may have:

a reverse tapered section, which extending from the squeezing section toward a base end of the punch, and whose outer diameter is gradually made smaller toward the base end; and a tapered section, extending from the squeezing section toward a front end of the punch, and whose outer diameter is gradually made smaller toward the front end.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
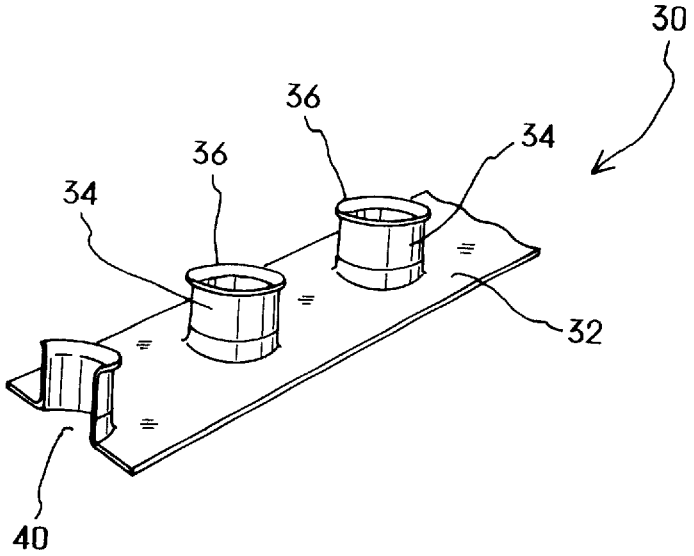
FIG. 1 is a perspective view of an embodiment of a heat exchanging fin of the present invention.

A heat exchanging fin of the present embodiment will be shown in FIG. 1.

As shown in FIG. 1, the heat exchanging fin 30 comprises: a thin plate section 32, which is made of a metallic thin plate, e.g., a thin aluminium plate; a plurality of through-holes 40; and a plurality of collars 34, which extend respectively upwardly from edges of the through-holes 40, having a prescribed height. There is formed a flange 36 at a front (upper) end of each collar 34.

Figure 2:
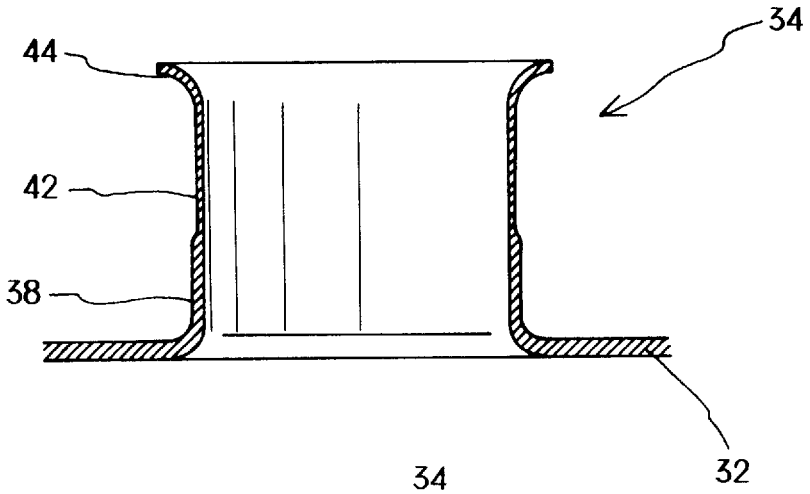
FIG. 2 is a sectional view of a collar of the heat exchanging fin shown in FIG. 1.

As shown in FIG. 2, an inner face of each collar 34 of the heat exchanging fin 30 is vertical with respect to the plate section 32. By employing the collars 34, a heat exchanging tube can be smoothly pierced through the collars 34 without engaging with any parts of the inner faces of the collars 34, and an outer face of the heat exchanging tube can be securely integrated with the inner faces of the collars 34.

A base (lower) end part 38 of the collar 34, which connects a lower end of the collar 34 with the plate section 32, is made thicker than a middle part 42 of the collar 34. An outer diameter of the base end part 38 of each collar 34 is greater than that of the middle part 42; namely the base end part 38 of the collar 34 is radially outwardly expanded. By employing the thicker base end parts 38, the strength of the base end parts 38 can be increased, so that the deformation of the collars 34 can be prevented when the heat exchanging tubes are pierced and integrated with the collars 34.

Figure 3:
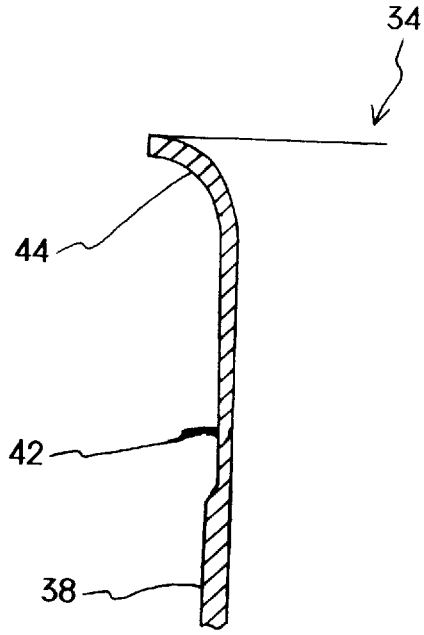
FIG. 3 is a partial sectional view of the collar shown in FIG. 2.

As clearly shown in FIG. 3, the thickness of the middle part 44 of the collar 34 is gradually made thicker toward the front end part 44. With this structure, forming cracks in the flanges 36 or breaking the flanges 36 can be prevented when the flanges 36 are formed at the front end parts 44 of the collars 34.

Next, a die-punch set for manufacturing the heat exchanging fins by the drawless manner will be explained.

Figure 4:
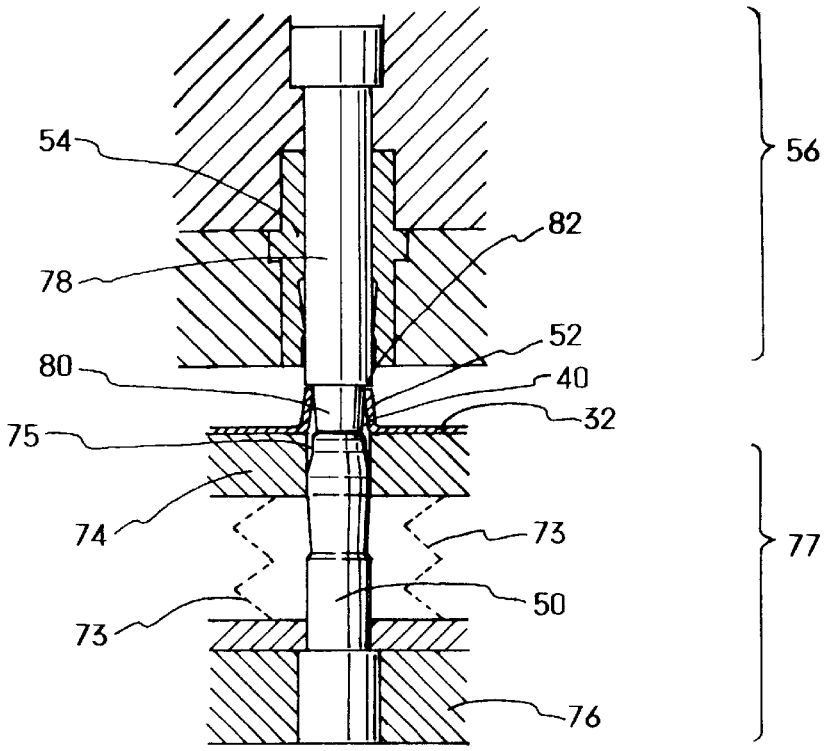
FIG. 4 is a sectional view of an embodiment of a die-punch set for manufacturing the heat exchanging fin of the present invention.

In FIG. 4, the die-punch set of the present embodiment has: an upper base 56; a die 54 in the upper base 56; a lower base 77; and a punch 50 in the lower base 77. The collars are formed by squeezing the projecting sections of the plate section 32 between the punch 50 and the die 54.

In the die 54 of the upper base 56, a knock-out 78 is always biased toward the lower base 77 by a biasing member (not shown), e.g., a spring, and a front (lower) end 80 of the knock-out 78 projects from a bottom face of the upper base 56. The front end 80 of the knock-out 78 enters the through-hole 40 of the plate section 32 when the upper base 56 is moved downwardly. Outer diameter of the front end 80 of the knock-out 78 is shorter than that of a middle section of the knock-out 78. Thus, there is formed a step section 82 in the knock-out 78.

Figure 10A:
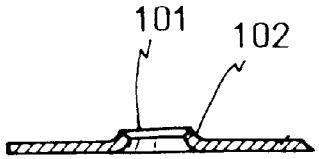
FIGS. 10A–10D are explanation views showing the steps of forming collared through-holes by a drawless manner.
Figure 10B:
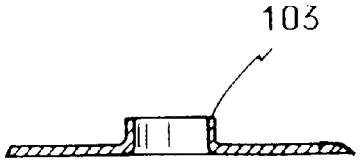
Figure 10C:
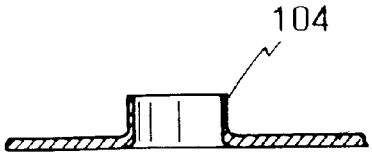
Figure 10D:
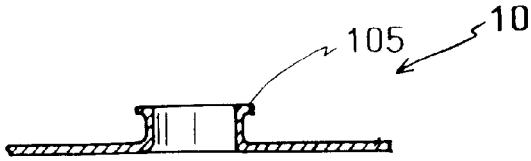
Figure 12:
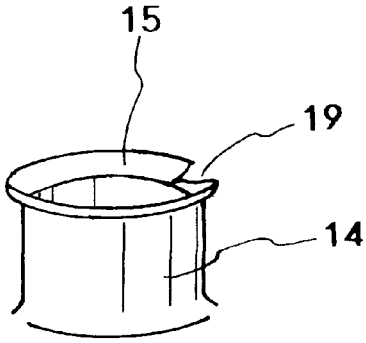
FIG. 12 is an explanation view showing a broken flange.
Figure 11:
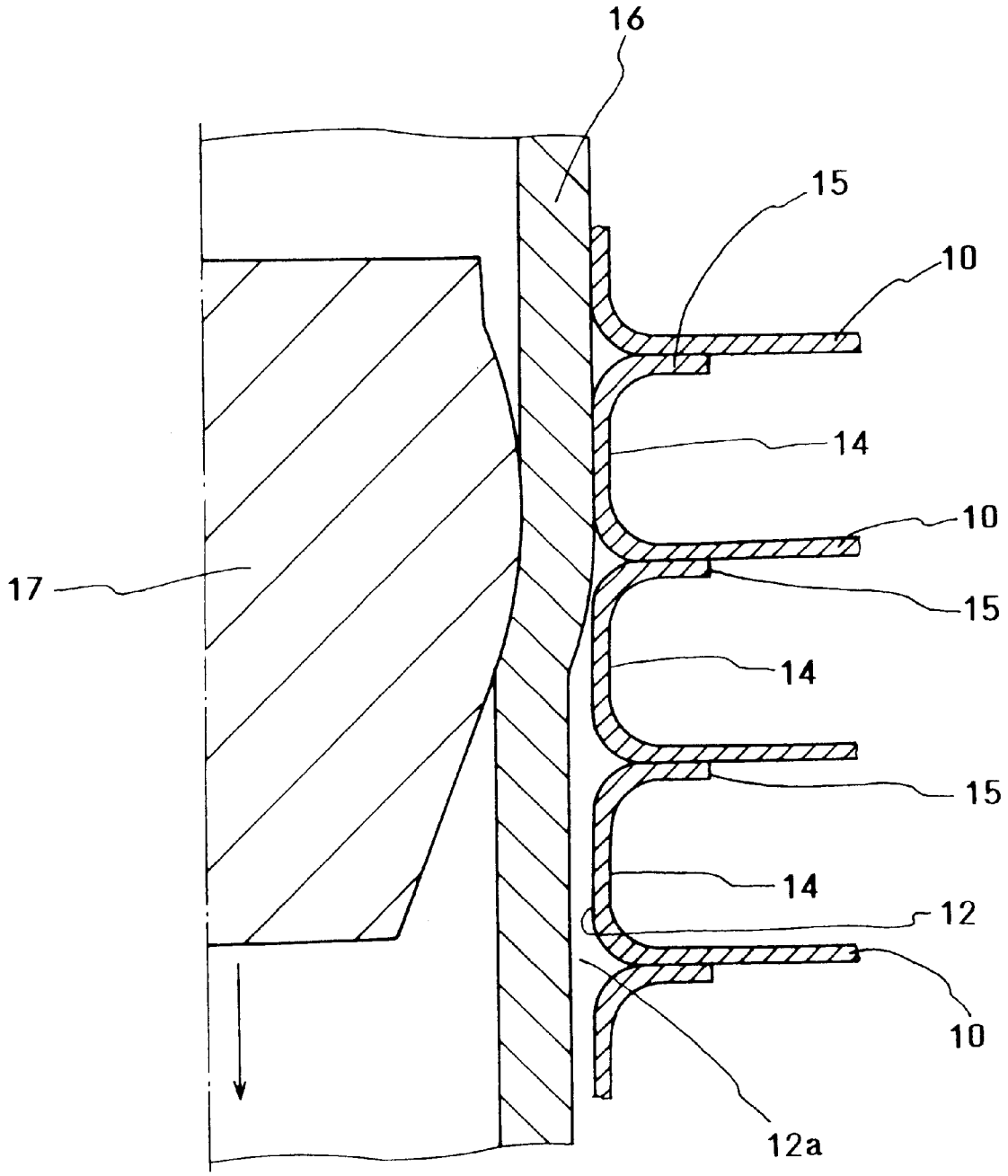
FIG. 11 is an explanation view showing the step of expanding a heat exchanging tube.
Figure 13:
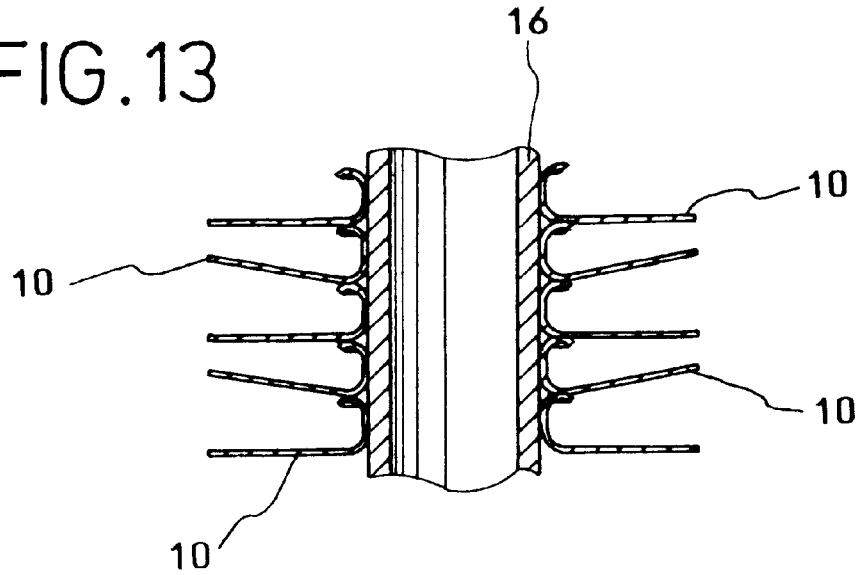
FIG. 13 is an explanation view showing the state in which the collars of the heat exchanging fins are deformed.

The lower base 77 further includes: a fixed plate 76; a lifter 74; and a biasing member 73 for biasing the lifter 74 toward the upper base 56. A lower end of the punch 50 is fixed to the fixed plate 76; a upper (front) end section of the punch 50 is inserted in a punch hole 75, which is formed in the lifter 74. The plate section 32, in which the through-holes 40 have been bored in the piercing step (see FIG. 10(a)) and the projected sections 52 have been formed around the through-holes 32 in the burring step (see FIG. 10(b)), is mounted on an upper face of the lifter 74.

Figure 5:
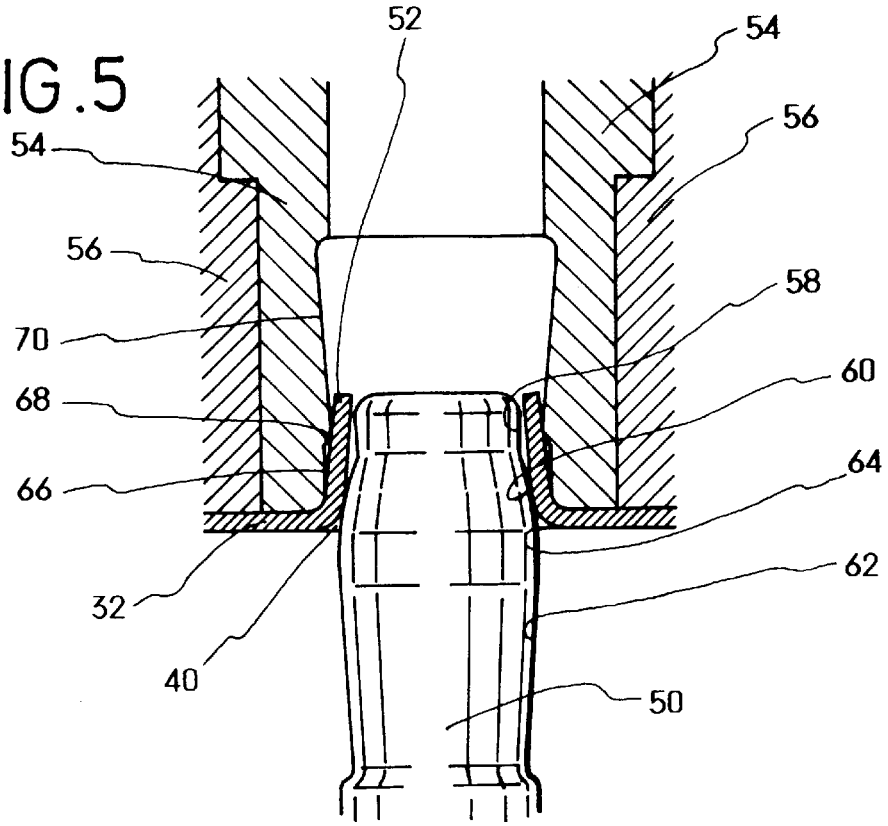
FIG. 5 is an explanation view showing a squeezing step executed in the die-punch set.

As clearly shown in FIG. 5, the punch 50 includes: a columnar section 58 formed at the upper end; a tapered section 60 downwardly extended from the columnar section 58, in which outer diameter is gradually made greater toward a base (lower) end of the punch 50; and a reverse tapered section 62 downwardly extended from the tapered section 60, in which outer diameter is gradually made smaller toward the base end of the punch 50.

The outer diameter of the columnar section 58 is designed to form a very narrow clearance between the inner circumferential face of the projected section 52 and an outer circumferential face of the columnar section 58 when the punch 50 enters the through-hole 40 of the plate section 32.

By forming the columnar section 58 and the tapered section 60, the front end section of the punch 50 can smoothly enter the through-holes 40 and the projecting sections 52 of the plate section 32.

The reverse tapered section 62 extends toward the base end of the punch 50 from the tapered section 60, and whose outer diameter is gradually made smaller toward the base end of the punch 50. Therefore, a border section between the tapered section 60 and the reverse tapered section 62 acts as a squeezing section 64. The squeezing section 64 squeezes the projecting section 52, with the inner circumferential face of the die 54, so as to form the projecting section 52 into the collar.

As clearly shown in FIG. 5, the die 54 includes: a first (lower) end to which the first (upper) end section of the punch 50 enters; a second (upper) end; a cylindrical section 66; a small diameter section 68; and a female tapered section 70.

The cylindrical section 66 of the die 54 extends a prescribed length from the first end of the die 54 toward the second end thereof. An inner circumferential face of the cylindrical section 66 is formed or arranged perpendicular to the plate section 32. The small diameter section 68 is provided with an upper side of the cylindrical section 66. The inner diameter of the small diameter section 68 is made smaller than that of the cylindrical section 66, so that the small diameter section 68 is capable of squeezing the projecting section 52 of the plate section 32 with the squeezing section 64 of the punch 50 when the squeezing section 64 passes through the small diameter section 68.

The inner diameter of the female tapered section 70, which is upwardly from the small diameter section 68, is gradually made greater toward the upper end of the die 54.

To manufacture the heat exchanging fin, the thin aluminium plate, in which the through-holes 40 have been bored in the plate section 32 and the projecting sections 52 have been formed around the through-holes 40, is mounted on the upper face of the lifter 74. At that time, the plate section 32 should be positioned to coincide with the through-hole 40 with the punch hole 40 of the lifter 74.

Figure 6:
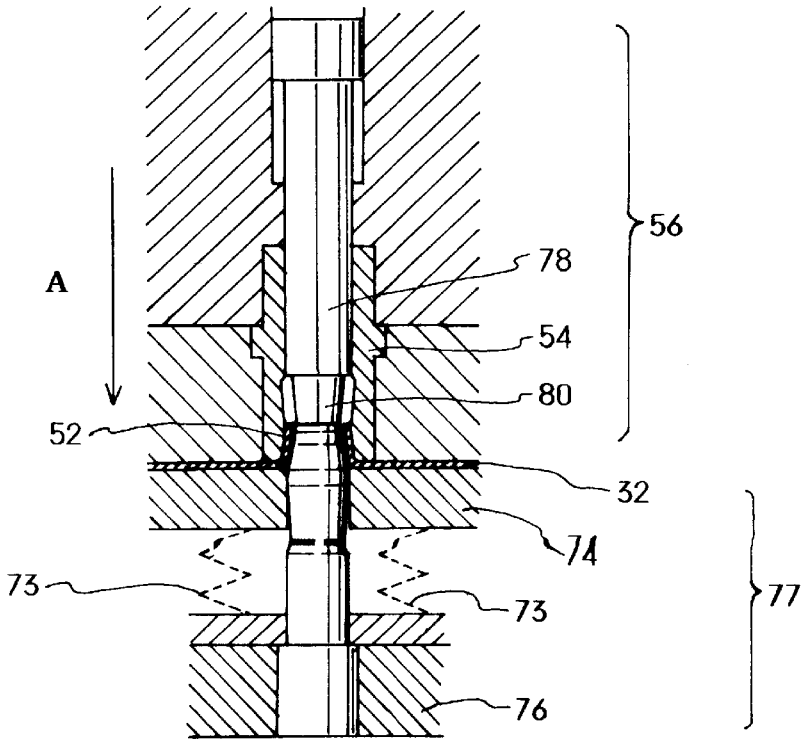
FIG. 6 is an explanation view showing the squeezing step executed in the die-punch set.

Next, the upper base 56 is downwardly moved, in a direction of an arrow "A" shown in FIG. 6, toward the lower base 77. The knock-out 78 is downwardly moved together with the upper base 56. The lower end 80 of the knock-out 78 enters the projecting section 52 of the plate section 32, so that the plate section 32 is positioned at a correct position. Note that, the lower end 80 of the knock-out contacts the upper end of the punch 50.

When the upper base 56 is further moved downwardly, a bottom face of the upper base 56 contacts the plate section 32, and the upper base 56 downwardly pushes the lifter 74 against the biasing force of the biasing member 73. With this action, the upper end section of the punch 50, whose upper end has contacted the tower end 80 of the knock-out 78, enters the die 54, so that the projecting section 52 of the plate section 32 can be squeezed.

When the projecting section 52 is squeezed until the projecting section 52 is formed into the collar having a prescribed height, the upper die 56 begins to move upwardly. The lifter 74, which is always biased toward the upper die 56 by the biasing member 73, is upwardly moved together with the upper base 56, so that the upper end section of the punch 50 comes out from the die 54.

When the upper base 56 is moved upwardly, there is formed a space between the upper die 56 and the lifter 74, and the step section 82 of the knock-out 78 ejects the collar of the plate section 32 from the die 54 to mount the plate section 32 on the upper face of the lifter 74. Then the plate section 32 is sent to the next manufacturing step.

Figure 7:
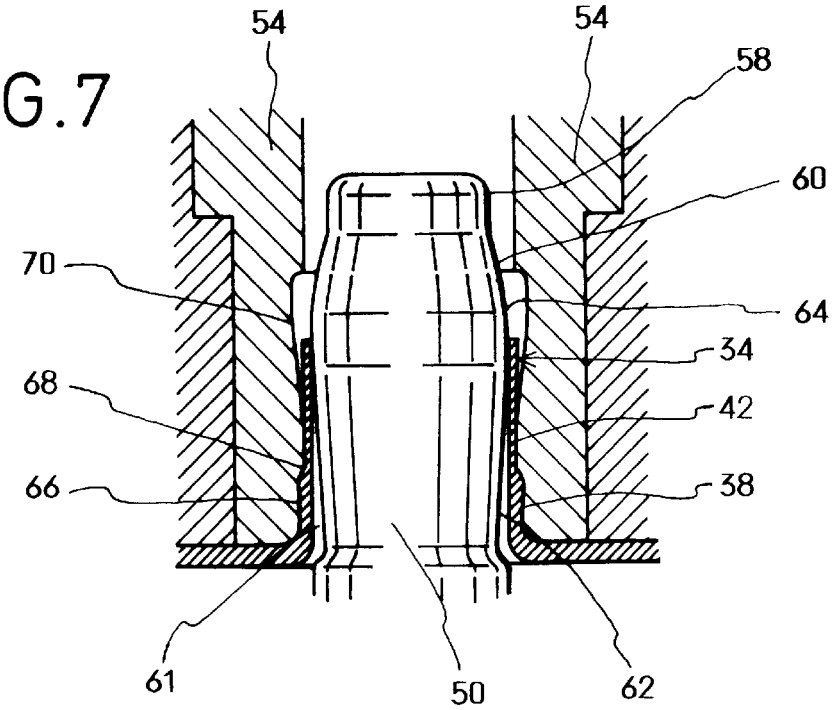
FIG. 7 is an explanation view showing the squeezing step executed in the die-punch set.

The actions of the upper base 56 and the lower base 77 have been described with reference to FIGS. 4–6. Successively, detail actions for forming the collar will be explained with reference to FIGS. 5 and 7.

In the step of squeezing the projecting section 52 which encloses the through-hole 40, firstly the columnar section 58 and the tapered section 60 enters the projecting section 52 as shown in FIG. 5. In this state, the projecting section 52 is not squeezed because the outer diameter of the columnar section 58 and the tapered section 60 are shorter than the inner diameter of the through-hole 40 and the projecting section 52.

When the squeezing section 64 of the punch 50 enters the projected section 52, the projecting section 52 is primarily squeezed between the squeezing section 64 of the punch 50 and the inner face of the cylindrical section 66 of the die 54. By the primary squeezing, the base end part 38 of the collar is formed.

When the squeezing section 74 of the punch 50 further enters the die 54, the projecting section 52, which has been primarily squeezed, is further squeezed between the squeezing section 64 of the punch 50 and the small diameter section 68. Clearance between the squeezing section 64 of the punch 50 and the inner circumferential face of the small diameter section 68 is smaller than that between the squeezing section 64 of the punch 50 and the inner circumferential face of the cylindrical section 66, so that the amount of squeezing by the small diameter section 68 is greater than that of the cylindrical section 66. Therefore, thickness of the middle part 42 of the collar 34 is thinner than that of the base end part 38 thereof.

When the squeezing section 64 of the punch 50 enters the female tapered section 70, the clearance between the squeezing section 64 and an inner circumferential face of the female tapered section 70 is gradually made wider toward the upper end of the die 54, so that the amount of squeezing is gradually reduced. With this structure, thickness of the upper end part 44 of the collar 34 is gradually made thicker toward the upper end of the collar 34 (see FIG. 2).

Note that, the projecting section 52, which is squeezed between the squeezing section 64 of the punch 50 and the inner circumferential face of the female tapered section 70, includes an upper end part of the projecting section 52, which is not squeezed and which is introduced into the female tapered section 70 by said squeezing action.

The sectional view of the collar 34, which has been formed in the above described manner, is shown in FIG. 3. The thickness of the base end part 38 of the collar 34 is thicker than that of the middle part 42 thereof. With this structure, the base end part 38 of the collar 34 has enough strength. Thus, deformation of the collars, which occurs when the heat exchanging tube is expanded to be integrated with the collars, can be prevented.

As clearly shown in FIG. 3, the thickness of the middle part 42 of the collar 34 is gradually made thicker toward the upper end part 44 thereof. With this structure, forming cracks in the upper end part 44 can be prevented when the flange is formed at the upper end of the collar 34.

The punch has the reverse tapered section 62, which is provided on the base end side of the squeezing section 64. By the reverse tapered section 62, there is formed a clearance 61 between the reverse tapered section 62 of the punch 62 and the base end part 66 of the collar 34 (see FIG. 7) when the squeezing section 64 of the punch 50 enters the female tapered section 70 of the die 54. By forming the clearance 61, machining oil can be easily introduced into the clearance 61, so that over heating and fusing of the punch 50 and the collar 34, which occur during the squeezing step, can be prevented.

Next, another die-punch set for manufacturing the heat exchanging fins of the present invention, in which the base end parts of the collars are thicker than the middle parts thereof, will be explained with reference to FIG. 8.

The die 54 has a first cylindrical section 66, which extends a prescribed length from the first (lower) end toward the second (upper) end. An inner circumferential face of the first cylindrical section 66 is formed or arranged perpendicular to the plate section 32. The die 54 further has a second cylindrical section 86, which extends from an upper end of the first cylindrical section 66 toward the second (upper) end. The inner diameter of the second cylindrical section 86 is made smaller than that of the first cylindrical section 66 so as to squeeze the projecting section 52 of the plate section 32 with the squeezing section 64 of the punch 50. And, an inner circumferential face of the second cylindrical section 86 is formed or arranged perpendicular to the plate section 32.

Figure 8:
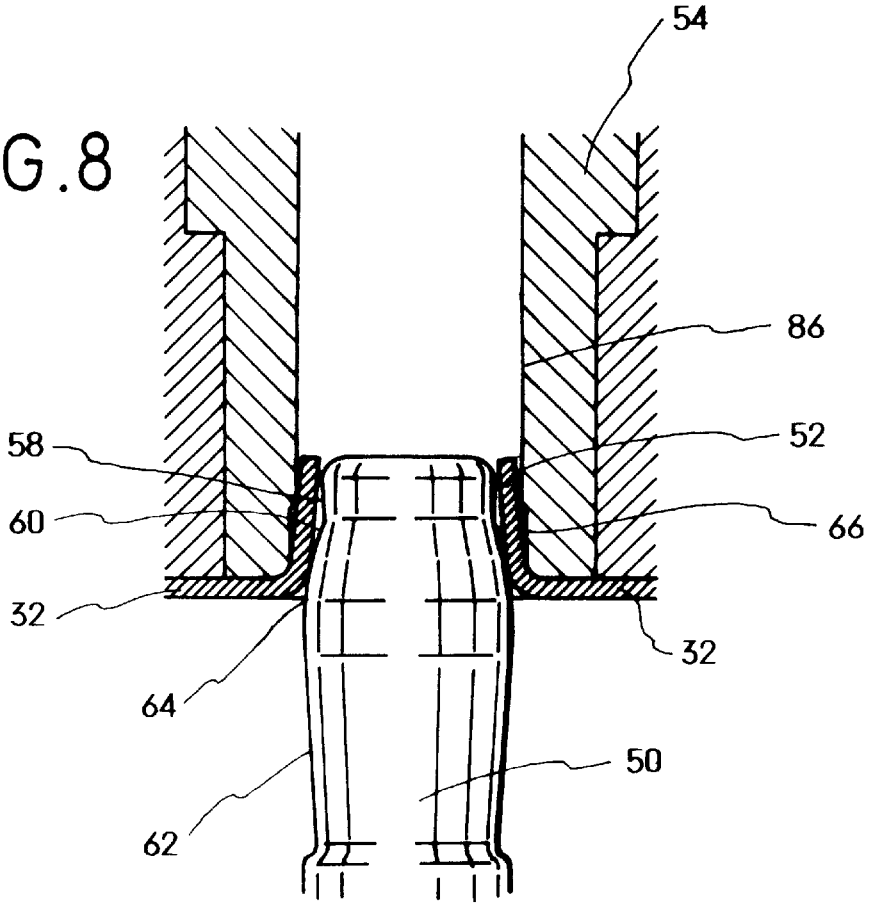
FIG. 8 is a sectional view of another embodiment of the die-punch set of the present invention.
Figure 9:
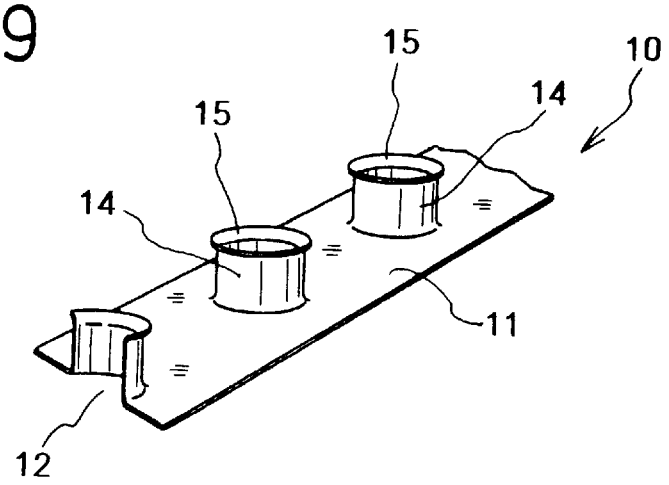
FIG. 9 is a perspective view of a conventional heat exchanging fin.

In the case of forming the collars 34 by squeezing the projecting sections 52, which respectively enclose the through-holes 40, by the die 54 shown in FIG. 8, firstly the upper base is downwardly moved toward the lower base so as to introduce the columnar section 58 and the tapered section 60 of the punch 50 into the projecting section 52 of the plate section 32, which has been inserted in the die 54. In this process, the projecting section 52 is not squeezed because the outer diameter of the columnar section 58 and the tapered section 60 are smaller than the inner diameter of the projecting section 52.

When the upper base is further moved downwardly until the squeezing section 64 of the punch 50 enters the projecting section 52, the projecting section 52 is primarily squeezed between the squeezing section 64 of the punch 50 and the inner face of the first cylindrical section 66. By the primary squeezing, the squeezed part is formed into the base end part of the collar.

The upper base is further moved downwardly so as to introduce the squeezing section 64 of the punch 50 into the second cylindrical section 86 of the die 54. Upon entering the second cylindrical section 86, the projecting section 52 is squeezed between the squeezing section 64 of the punch 50 and the inner face of the second cylindrical section 86. The part, which has been squeezed between the squeezing section 64 of the punch 50 and the inner face of the second cylindrical section 86, is formed into the upper end part of the collar.

Note that, the projecting section 52, which is squeezed between the squeezing section 64 and the inner face of the second cylindrical section 86 (not shown in FIG. 8), includes an upper end part of the projecting section 52, which is not squeezed and which is introduced into the second cylindrical section 86 by said squeezing action.

Since the clearance between the squeezing section 64 of the punch 50 and the inner face of the first cylindrical section 66 is wider than that between the squeezing section 64 and the inner face of the second cylindrical section 86, the amount of squeezing by the second cylindrical section 86 is greater than that of the first cylindrical section 66. Therefore, the thickness of the base end part of the collar, which has been squeezed by the first cylindrical section 66, is thicker than the middle part thereof.

By making the base end parts of the collars, which connect the collars to the plate section 32, thicker than the middle parts thereof, the base end part of the collar can have enough strength. Thus, deformation of the collars, which occurs when the heat exchanging tube is expanded to be integrated with the collars, can be prevented.

Figure 14:
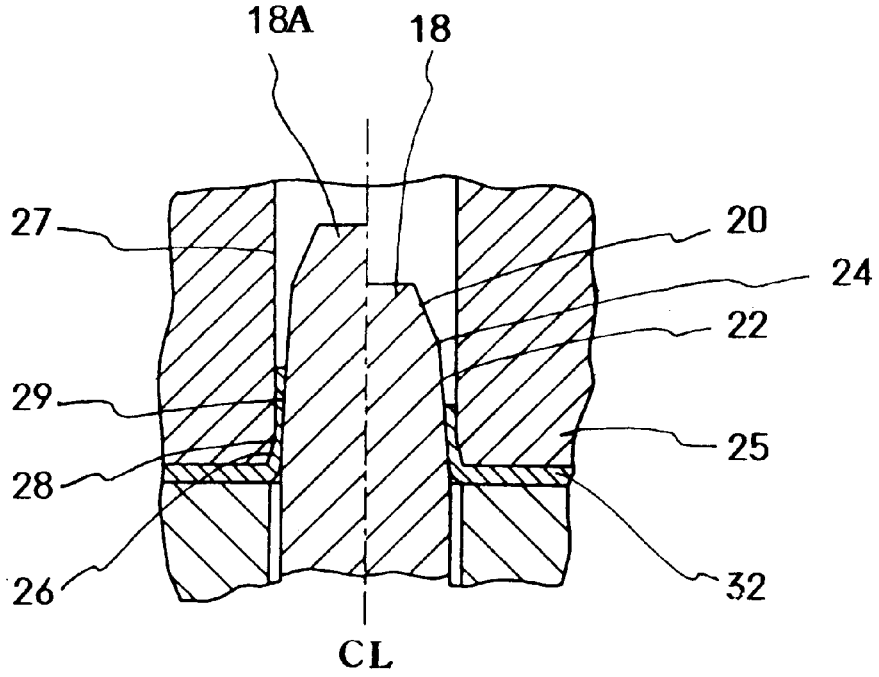
FIG. 14 is a sectional view of a die-punch set, which is disclosed in the U.S. Pat. No. 5,159,826.

By the way, another example of a heat exchanging fin was disclosed in the U.S. Pat. No. 5,159,826. The heat exchanging fin is shown in FIG. 14. The thickness of the collar is gradually made thicker toward a front (upper) end thereof.

To form such heat exchanging fins, a punch 18 of a die-punch set has a first tapered section 20 and a second tapered section 22, whose outer diameters are gradually made greater toward a front (upper) end of the punch 18. Inclination angle of the first tapered section 20 with respect to a center line CL of the punch 18 is wider than that of the second tapered section 22. With this structure, a border section 24 between the first tapered section 20 and the second tapered section 22 acts as the squeezing section of the punch 18.

A die 25 of the die-punch set has a female tapered section 26, which upwardly extends a prescribed length from a lower end of the die 25 and whose inner diameter is gradually smaller toward an upper end thereof. A cylindrical section 27, whose inner circumferential face is arranged perpendicular to the plate section 32, extends upwardly from an upper end of the female tapered section 26.

With this structure, the punch 18 squeezes a projecting section 29 of the plate section 32 and proceeds to a position 18A in the die 25. With the squeezing action by the punch 18 and the die 25, an inner circumferential face of the projecting section 29 is formed along an outer circumferential face of the second tapered section 22. Thus, an inner space of the collar is formed like a female tapered space whose inner diameter is gradually made greater toward a lower end.

However, if the inner space of the collar is formed into the female tapered space, it is difficult to pierce the heat exchanging tube through the collars or to securely integrate the heat exchanging tube with the collars.

On the other hand, by employing the heat exchanging fins of the present embodiments, the inner circumferential faces of the collars can be formed perpendicular to the plate sections of the heat exchanging fins. So the heat exchanging tube can be smoothly pierced through the collars and securely integrated with the collars.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A die-punch set for forming a plurality of collars in a plate section of a heat exchanging fin, through which a heat exchanging tube will be pierced, by squeezing projecting sections of the plate section, each projecting section projecting from an edge of each through-hole in the plate section, between an inner face of die and an outer face of a punch until reaching a prescribed height, comprising:

said punch having a squeezing section in a front end section;

said die includes:

a first end wherein the front end of said punch enters;

a second end being an opposite end with respect to said first end;

a cylindrical section extending a prescribed length from said first end toward said second end, wherein an inner face of said cylindrical section is arranged perpendicular to the plate section;

a smaller diameter section being provided on said second end side of the cylindrical section, wherein an inner diameter of said small diameter section is made smaller with respect to said cylindrical section so as to squeeze the protecting section with the squeezing section of said punch;

a female tapered section, extending from said smaller diameter section toward said second end, and whose inner diameter is gradually made greater toward said second end; and a front end of said collar exists in said second cylindrical section of said die when the collar is completely squeezed.

2. The die-punch set according to claim 1, wherein said punch has a reverse tapered section, extending from the squeezing section toward a base end of said punch, and whose outer diameter is gradually made smaller toward the base end.

3. The die-punch set according to claim 1, wherein said punch has a tapered section, extending from the squeezing section toward a front end of said punch, and whose outer diameter is gradually made smaller toward the front end.

4. The die-punch set according to claim 1, wherein said punch has:

a reverse tapered section, extending from the squeezing section toward a base end of said punch, and whose outer diameter is gradually made smaller toward the base end; and a tapered section, extending from the squeezing section toward a front end of said punch, and whose outer diameter is gradually made smaller toward the front end.

* * * * *